US011346127B2

(12) United States Patent
Lai

(10) Patent No.: US 11,346,127 B2
(45) Date of Patent: May 31, 2022

(54) HOOK LOCK WITH DUAL LOCKING FUNCTION

(71) Applicant: The Sun Lock Company Limited, Tuen Mun (HK)

(72) Inventor: Karl Lai, Tai Po (HK)

(73) Assignee: THE SUN LOCK COMPANY LIMITED, Hong Kong (HK)

( * ) Notice: Subject to any disclaimer, the term of this patent is extended or adjusted under 35 U.S.C. 154(b) by 77 days.

(21) Appl. No.: 16/887,356

(22) Filed: May 29, 2020

(65) Prior Publication Data

US 2020/0408001 A1 Dec. 31, 2020

Related U.S. Application Data

(60) Provisional application No. 62/867,358, filed on Jun. 27, 2019.

(51) Int. Cl.
*E05B 37/02* (2006.01)
*E05B 67/24* (2006.01)
(Continued)

(52) U.S. Cl.
CPC ..... *E05B 37/025* (2013.01); *E05B 37/0034* (2013.01); *E05B 37/0068* (2013.01);
(Continued)

(58) Field of Classification Search
CPC ..... E05B 17/044; E05B 37/0031; E05B 37/0034; E05B 37/0041; E05B 37/0068;
(Continued)

(56) References Cited

U.S. PATENT DOCUMENTS 5,042,277 A * 8/1991 Jenn-Rong ..... E05B 67/08 70/28
5,175,709 A 12/1992 Lai
(Continued)

FOREIGN PATENT DOCUMENTS

CN 208456295 U 2/2019

OTHER PUBLICATIONS

Combined Search and Examination Report dated Oct. 23, 2020 issued by UKIPO in corresponding Application No. GB2008470.3, 6 pages.

*Primary Examiner* — Christopher J Boswell
(74) *Attorney, Agent, or Firm* — Ware, Fressola, Maguire & Barber LLP

(57) ABSTRACT

A lock has a hook and a locking finger to form a locking loop. The hook is fixedly attached to the lock body, whereas the locking finger can be pivoted to disengage from the hook to open the lock. The pivotal movement of the locking finger is controlled by a latch and an extended edge. The latch has a tip and the locking finger has a cut-out to receive the tip when the lock is locked. When the lock is locked, a spindle prevents the extended edge from moving toward the latch for releasing the tip from the cut-out. When the lock is opened by the combination mechanism, the spindle is moved away to allow the extended edge to move toward the latch to release the tip from the cut-out. When the lock is opened by the key mechanism, turning the cylinder causes the extended edge to move the latch downward.

17 Claims, 7 Drawing Sheets

(51) Int. Cl.
*E05B 67/14* (2006.01)
*E05B 37/00* (2006.01)
*E05B 17/04* (2006.01)

(52) U.S. Cl.
CPC ..... *E05B 67/14* (2013.01); *E05B 67/24* (2013.01); *E05B 17/044* (2013.01)

(58) Field of Classification Search
CPC ..... E05B 37/02; E05B 37/025; E05B 67/06; E05B 67/08; E05B 67/10; E05B 67/14; E05B 67/24
See application file for complete search history.

(56) References Cited

U.S. PATENT DOCUMENTS 5,901,587 A * 5/1999 Chen ..... E05B 37/025 70/28
6,029,481 A 2/2000 Lai
6,035,672 A 3/2000 Lai
6,164,096 A 12/2000 Lai
D439,824 S 4/2001 Lai
D439,825 S 4/2001 Lai
6,381,997 B1 * 5/2002 Chen ..... E05B 37/025 70/28
6,408,660 B1 6/2002 Lai
6,474,116 B1 11/2002 Lai
D472,790 S 4/2003 Lai
6,675,614 B2 1/2004 Lai
6,729,166 B1 5/2004 Lai
6,742,366 B1 6/2004 Lai
D498,132 S 11/2004 Lai
6,883,355 B2 4/2005 Lai
6,928,842 B1 * 8/2005 Huang ..... E05B 37/025 70/21
D511,673 S 11/2005 Lai
7,117,698 B2 10/2006 Lai
7,131,299 B1 * 11/2006 Huang ..... E05B 37/025 70/21
7,140,209 B2 11/2006 Lai
7,201,026 B2 * 4/2007 Yu ..... E05B 37/025 70/21
7,213,425 B2 * 5/2007 Ling ..... E05B 37/025 70/21
7,222,506 B2 * 5/2007 Yu ..... E05B 37/025 70/21
7,225,648 B2 6/2007 Lai
7,467,531 B2 12/2008 Lai et al.
7,562,545 B2 7/2009 Lai et al.
7,685,851 B2 3/2010 Lai
7,765,840 B2 8/2010 Lai et al.
8,096,150 B2 1/2012 Lai et al.
8,261,583 B2 9/2012 Lai et al.
8,511,118 B2 8/2013 Lai et al.
8,661,861 B2 3/2014 Lai
8,776,556 B2 7/2014 Lai
8,826,703 B2 9/2014 Lai
8,919,155 B2 12/2014 Lai
8,931,313 B2 1/2015 Lai
9,206,625 B2 12/2015 Lai
9,228,376 B2 1/2016 Lai
9,464,460 B2 10/2016 Lai
9,487,969 B2 11/2016 Lai
9,556,560 B2 1/2017 Lai
D789,174 S 6/2017 Lai
9,803,398 B2 10/2017 Lai
9,890,559 B2 2/2018 Lai
10,047,541 B2 8/2018 Lai
10,221,591 B2 3/2019 Lai
D864,695 S 10/2019 Lai
10,443,272 B2 10/2019 Lai
2006/0123857 A1 6/2006 Ling et al.
2006/0130540 A1 6/2006 Lin
2008/0011026 A1 * 1/2008 Huang ..... E05B 37/025 70/21
2009/0229329 A1 * 9/2009 Star ..... E05B 37/025 70/284
2021/0115703 A1 * 4/2021 Yu ..... E05B 37/025
2021/0189766 A1 * 6/2021 Lai ..... E05B 37/025

* cited by examiner

HOOK LOCK WITH DUAL LOCKING FUNCTION

CROSS-REFERENCE TO RELATED APPLICATIONS

This application claims priority under 35 USC § 119 to U.S. Provisional Patent Application No. 62/867,358 filed on Jun. 27, 2019, the entire contents of which are hereby incorporated by reference.

TECHNICAL FIELD

The present invention is directed to padlocks, in particular hook locks.

BACKGROUND OF THE INVENTION

Padlocks are well known in the art. Such locks can be opened by a combination mechanism. Padlocks can also be opened by a key. Many padlocks can be opened by either a combination mechanism or a key mechanism (sometimes referred to as a dual locking function).

A hook lock is a type of padlock that has a locking-finger that can pivot between a lock position and an unlock (open) position.

SUMMARY OF THE INVENTION

The following is a hook lock (padlock) with a dual locking function enclosed in a locking body/housing. The hook lock can be opened by a combination mechanism or by a key mechanism. The key mechanism can be used to override the combination mechanism like many TSA luggage locks which are able to allow a TSA agent to open the lock with an overriding key mechanism. The hook lock has a cylinder which contains a first wall and a second wall to receive a control pole of a locking-finger in between these two walls in the cylinder.

Thus, the present invention relates to a lock comprising a body having a first body portion and a second body portion, a hook fixedly disposed on an end of the first body portion, a locking finger pivotally coupled to the hook to prevent opening of the lock, a latch movable in a latch movement direction between a first latch position to prevent the locking finger from decoupling from the hook and a second latch position to allow the locking finger to pivotally decouple from the hook to open the lock, a latch-controlling mechanism operable in a control position to prevent movement of the latch, and in a release position to cause the latch to move from the first latch position to the second latch position, a spindle movable between a first spindle position to keep the latch-controlling mechanism in the control position and a second spindle position to allow the latch-controlling mechanism to operate in the release position; a combination mechanism located in the second body portion, the combination mechanism having a plurality of dials arranged from top to bottom relative to the body, the dials configured to control rotational movement of a plurality of clutches, the plurality of clutches configured to control movement of the spindle between the first spindle position when the dials are not in a lock open code and the second spindle position when the dials are in a lock open code, and a key overriding-mechanism to allow the latch-controlling mechanism to operate in the release position for causing the latch to move from the first latch position to the second latch position while the spindle is located in the first spindle position.

Another embodiment of the present invention is the lock as described above, wherein the locking finger comprises a cut-out, and the latch comprises a tip arranged to engage with the cut-out of the locking finger when the latch is located in the first latch position for preventing the opening of the lock, and when the latch is located in the second latch position, the tip is caused to disengage from the cut-out of the locking finger.

Another embodiment of the present invention is the lock as described above, wherein the latch further comprises a contact member positioned in relationship to the tip, and the key overriding-mechanism comprises a key-operated cylinder, wherein the latch-controlling mechanism comprises an extended edge fixedly attached to the cylinder, the extended edge having an edge end positioned in relationship to the contact member of the latch, and wherein when the cylinder is turned by a key, the edge end of the extended edge is arranged to cause the contact member to move in the latch movement direction for disengaging the tip of the latch from the cut-out of the locking finger.

A further embodiment of the present invention is the lock as described above, wherein the latch-controlling mechanism further comprises a button positioned in relationship to the combination mechanism, the button coupled to the cylinder for movement together, wherein when the spindle is located in the second spindle position, the button can be pushed to move the extended edge in an edge movement direction and wherein the edge end is arranged to engage with the contact member of the latch for disengaging the tip of the latch from the cut-out of the locking finger, and when the spindle is located in the first spindle position, the button is prevented from moving the extended edge in the edge movement direction.

A further embodiment of the present invention is the lock as described above, wherein the extended edge has an edge slope and the latch has a latch slope arranged to contact the edge slope, and wherein when the extended edge is moved in the edge movement direction, the latch is caused to move in the latch movement direction from the first latch position to the second latch position by the edge slope of the extended edge.

A further embodiment of the present invention is the lock as described above, wherein the extended edge has an edge surface, and the contact member of the latch has a contact surface arranged to contact the edge surface, and wherein when the cylinder is turned, the edge surface of the extended edge causes the contact surface of the contact member to move in the latch movement direction so as to disengage the tip of the latch from the cut-out of the locking finger.

A further embodiment of the present invention is the lock as described above, wherein the first body portion has an opening dimensioned to receive the button, the opening having a cut edge arranged to prevent the button from falling out of the opening, and the button has a wall engaged with the cut edge of the opening to prevent the button from rotation, and wherein the cylinder has a control edge and the button has a slot dimensioned to receive the control edge, allowing the cylinder to turn relative to the button.

A further embodiment of the present invention is the lock as described above, wherein each of the clutches has an outer cylindrical surface to dispose thereon one or more first fins and a second fin longer than the first fins, and each of the dials has an inner ring to provide a plurality of teeth, a gap of two adjacent teeth dimensioned to receive one of the first and second fins to cause the clutches to rotate together with the dials, and wherein each of the clutches further comprises an inner cylindrical wall having thereon an opening gap, and the spindle comprises a plurality of protrusions, each protrusion associated with the opening gap of one of the clutches, wherein when the dials are rotated to match a lock open code, the clutches are also rotated such that the opening gap of each of the clutches is aligned with the associated protrusion, allowing the spindle to move from the first spindle position to the second spindle position.

A further embodiment of the present invention is the lock as described above, wherein the second body also has a plurality of notches, each positioned in relationship to one of the clutches, wherein when the spindle is located in the second spindle position, the plurality of clutches can be pushed away from a bottom end of the second body portion, causing the teeth of the dials to disengage from the first and second fins of the clutches and also causing the second fin of each of the clutches to engage with one of the notches so as to prevent the clutches from rotation relative to the body and allowing the dials to rotate without the clutches to form a different lock open code.

A further embodiment of the present invention is the lock as described above, wherein the cylinder has a plurality of movable wafers and the button has a wafer slot dimensioned to receive the wafers so as to prevent the cylinder from rotation relative to the button, and wherein when the key is inserted into the cylinder, the wafers are caused to retrieve into the cylinder and move out of the wafer slot of the button, allowing the cylinder to turn to move in the latch movement direction so as to disengage the tip of the latch from the cut-out of the locking finger.

DETAILED DESCRIPTION

Locked Mode (FIGS. 1A-11)

Figure 1A:
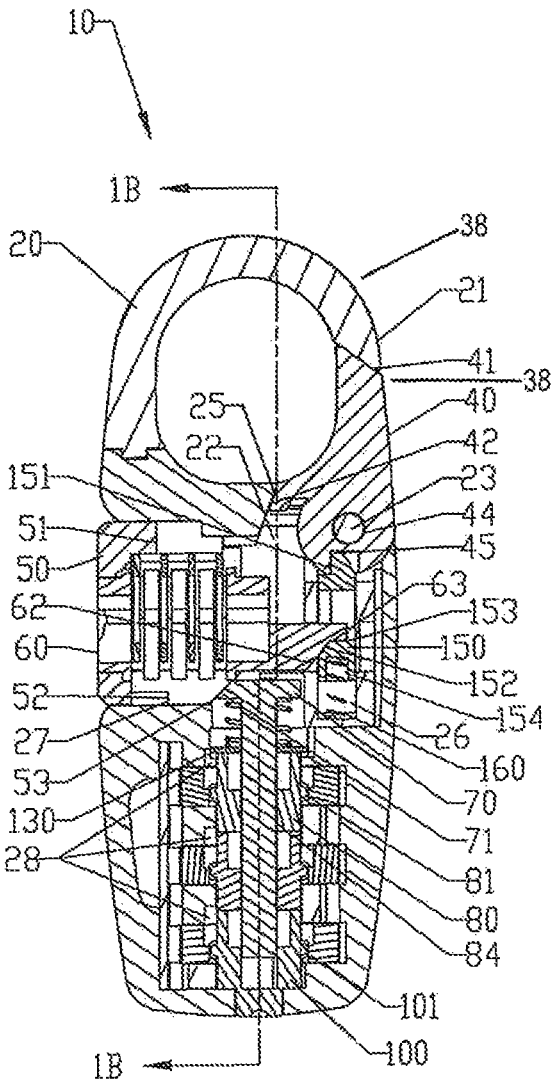
FIG. 1A is a cross-sectional view of the padlock taken along line 1A-1A of FIG. 1B.
Figure 1B:
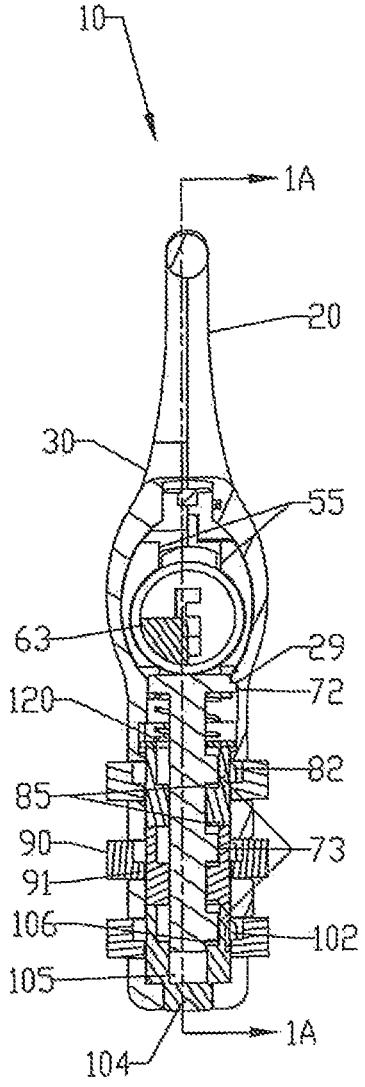
FIG. 1B is a cross-sectional view of the padlock taken along line 1B-1B of FIG. 1A.

As seen in FIGS. 1A-11, a hook lock 10 contains an overall body formed by first body half 20 and second body half 30. The overall body has a hook 21 as a member to hook up a locking object (not shown) to the hook lock. A locking-finger 40 contains a cut-out 45 wherein the movement is controlled by a latch 150. The movement of the locking-finger 40 is a pivotal (rotational) movement. As seen in FIG. 1A, when the hook lock is locked (in a lock position), a loop 38 is formed by first body half and locking-finger 40. When the hook lock is in an open position as seen in FIGS. 11A, 12A and 13A, the locking-finger pivots counterclockwise to open loop 38.

The locking-finger 40 contains a pole-receiving-hole 44 which is placed in between the pivot-pole 23 and the pole-receiving-hole 32 of the lock body 20/30. The locking-finger 40 further comprises a torque-spring-wall 43 which has a torque spring 110. One end of the torque spring is placed in the torque-spring-slot 24 of the body 20 and the other end of the torque spring 110 is placed in the torque-spring-wall 43 of the locking-finger. The locking-finger 40 further comprises a restriction-wall 42 which prevents the locking-finger 40 from pivoting counter-clockwise away from the lock position. Thus, the restriction-wall 42 contacts the stopping-edge 25/33 of the body 20/30 to prevent the locking-finger 40 from pivoting further counter-clockwise such that a locking-protrusion 41 stays in the lock position.

Key Locking Mechanism

As seen in FIGS. 1A-11, a cylinder 60 is assembled inside of button 50 wherein the control-edge 61 of the cylinder is placed inside of the rotational-control-slot 54 of the button. In the lock position, a wafer 65 (see FIG. 6B) is inserted in the cylinder so that a wafer's spring pushes outward and contacts a wafer slot 55 to prevent the cylinder from rotational movement. Also, the button 50 has a primary function to act as a cylinder housing and the button has a design that installs on a cylinder-receiving-hole 22/31 of the body 20/30 such that the button 50 has no rotational movement. A wall 52 of the button 50 is configured to prevent the button from having any rotational movement and also the wall 52 contacts the cut-edge 27/35 of the body 20/30 such that the button 50 does not travel further than the cut-edge 27/35 to prevent the button from falling out of the hole 22/31. The cylinder has a slope 62 and an extended-edge 63 which is for connecting to a slope 152 of the latch 150 and a surface 153 of the latch. Since the cylinder has neither rotational nor horizontal movement, then the slope 62 and an extended-edge 63 remain stationary when in the lock position. As the cylinder 60 and button 50 have no movement, then the tip 151 of the latch 150 will remain engaged with the cut-out 45 of the locking-finger 40 so that the locking-finger 40 remains in the lock position.

The button 50 performs a second function; namely, control of the spindle 70. The design of the button 50 contains a slope 53 which contacts a slope 71 of the spindle 70. In the lock position, the opening-gap 83 of the clutch 80 is not aligned with the protrusion 73 of the spindle 70. This prevents the spindle from pushing downward that otherwise would allow the button 50 to have horizontal movement. Since the spindle has no movement, then the slope 71 of the spindle 70 will not move so that the slope 53 of the button cannot be pushed inward to move the slope 62 of the cylinder 60. As these elements are stationary, the tip 151 of the latch 150 is still engaged with the cut-out 45 of the locking-finger 40. Also, since the cylinder 60 contains no rotational movement, then the extended-edge 63 will not contact the surface 153 of the latch 150 so that the tip 151 of the latch 150 remains engaged to the cut-out 45 of the locking-finger 40. The padlock thus remains in the lock position (first latch position).

The latch 150 is in the latch-path 26/36 of the body 20/30. A latch spring 160 is placed in the spring-hole 154 of the latch 150 to push the latch toward the locking-finger 40.

Combination Mechanism

In the lock position, each dial 90 which contains teeth 91 engages the short-fin 81 and the long fin 82 of the clutch 80. When in the lock position, the dials are not in a lock open code configuration. The rotation of each dial 90 in the lock position allows the rotation of the clutch 80 in the same manner. The hole 84 of the clutch 80 allows the spindle 70 to pass through the middle of the clutch 80. In the lock position, the opening-gap 83/103 of the clutch 80/reset-button-with-clutch 100 is not fully aligned with protrusion 73 of the spindle 70, which prevents the spindle from moving downward.

The edge 72 of the spindle 70 has a dual function. The first function is to prevent the spindle from moving further upward in the lock position as the edge 72 contacts the spindle-wall 29 of the body 20. The spindle spring 120 pushes the separation-ring 130 and the clutch 80 away from the edge 72 of the spindle 70. In this case the edge 72 contacts the spindle-wall 29 of the body 20 to prevent any further upward movement to misalign the relationship in the lock position of the clutch 80 and the protrusion 73 of the spindle 70. The second function of the edge 72 is to prevent any rotational movement occurring with respect to the spindle 70.

In the lock position, the clutch 80 contains a set of faulty-gates 85 on the top and bottom and a set of faulty-gates 106 on the reset-button 100. If the padlock 10 is in the lock position, an intruder can push the button 50 and can rotate the dials 90 and rotate the clutches 80 and the reset-button-with-clutch 100 in the same manner. The clutch contains a set of faulty gates to make the intruder push button 50 and then force the spindle to push a little downward and allow the protrusion 73 of the spindle 70 to engage with the faulty-gates 85 and 106. As they engage, then the intruder cannot further rotate the dial since the protrusion 73 is jammed into the faulty-gates 85/106 of the clutch 80/reset-button 100 to prevent the trial of the opening-gap.

Figure 12A:
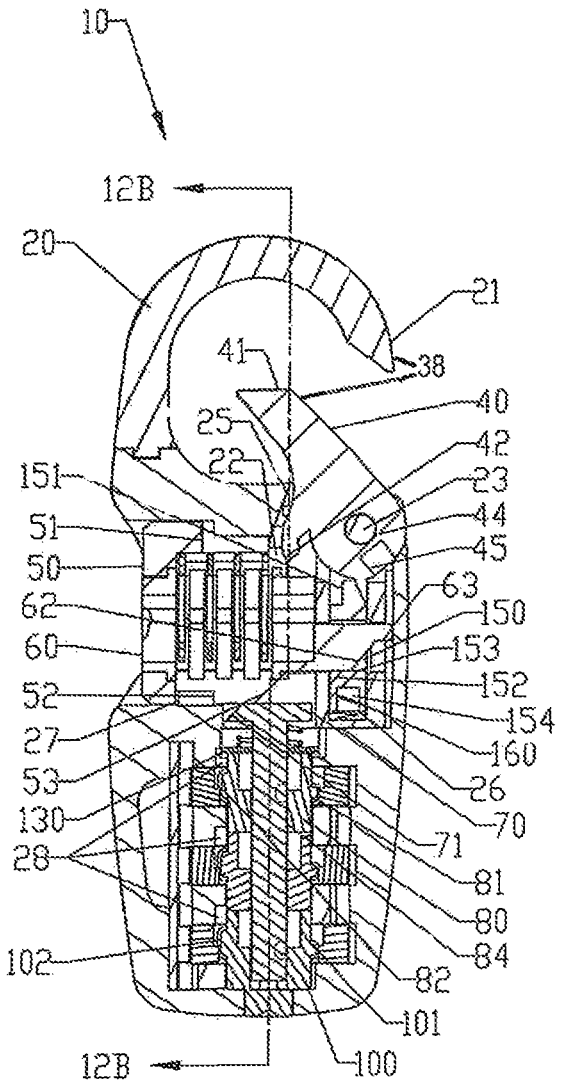
FIG. 12A is a cross-sectional view of the first body half taken along line 12A-12A of FIG. 12B.
Figure 12B:
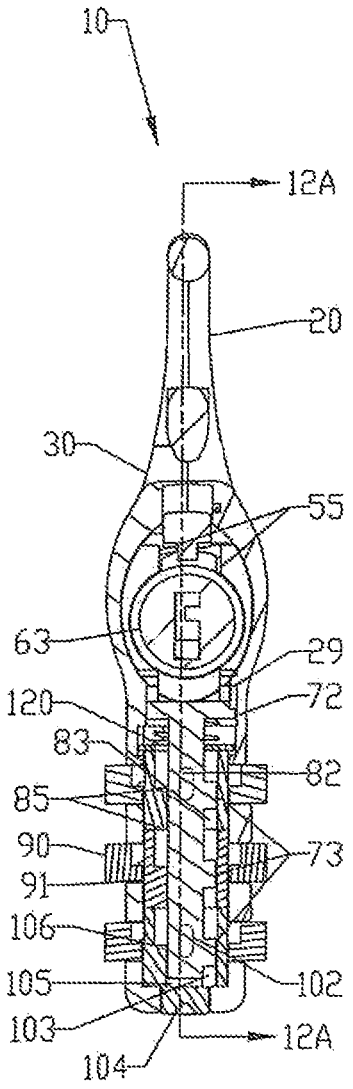
FIG. 12B is a cross-sectional view of the first body half taken along line 12B-12B of FIG. 12A.
Figure 13A:
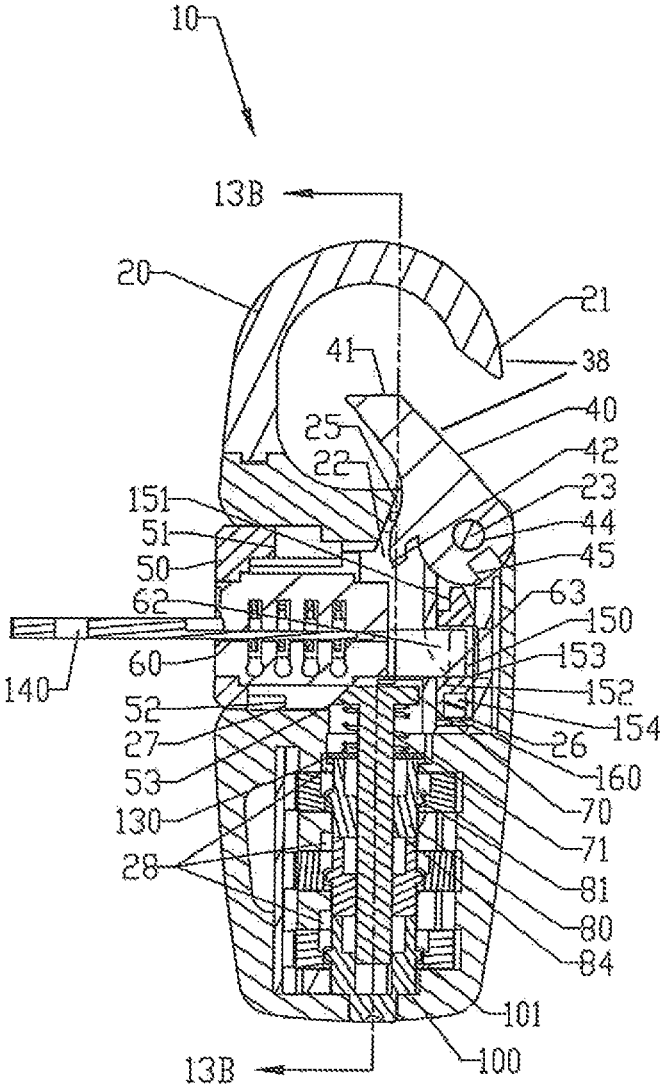
FIG. 13A is a cross-sectional view of the first body half taken along line 13A-13A of FIG. 13B showing insertion of a key.

Unlock by Combination (FIGS. 12A-12B)

The lock can be opened (unlocked) by a lock open code of the combination mechanism, where the teeth 91 of dials 90 engage the short-fin 81 and the long fin 82 of the clutch 80. The dials 90 are then rotated to the lock open code which means that the opening-gap 83 of the clutch 80 and the opening-gap 103 of the reset-button-with-clutch 100 are aligned to the protrusion 73 of the spindle 70.

In the meanwhile, the user can push button 50 such that the slope 53 of the button will contact the slope 71 of the spindle. Since the opening-gap 83/103 of the clutch 80/reset-button 100 are aligned properly, then the spindle is forced to push downward. As the spindle moves downward then the button 50 can be further pushed inward relative to the lock body 20/30. As the button moves inward the cylinder moves in the same manner. The slope 62 of the cylinder 60 contacts the slope 152 of the latch 150 and makes the latch 150 move downward. As the cylinder moves further rightward (see FIGS. 12A and 12B), then the tip 151 of the latch 150 will disengage away from the cut-out 45 of the locking-finger 40. This is the second lock position. As the locking-finger 40 pivots (rotates), the locking-protrusion 41 will rotate such that there is a gap in between the locking-protrusion 41 and the hook 21 of the lock body 20. The user can then slide the locked object (not shown) away from the hook 21 and the locking-protrusion 41 away from the lock body 20/30 to open the lock (that is, open loop 38).

When the user pushes the locking-finger 40 back to the lock position, the cutout 45 of the locking-finger will line up to the latch 150. The latch spring 160 pushes the tip 151 to engage back to the cutout 45 of the locking-finger to the lock position. The slope 151 pushes the slope 62 of the cylinder 60 leftward (see FIGS. 12A and 12B) such that the cylinder will be pushed leftward back to the lock position, and the slope 53 of the button 50 will move away from the slope 71 of the spindle 70. As these elements are moved away, then the user can rotate the dials and clutches such that the opening-gap 83 will no longer align with the protrusion 73 of the spindle for locking the padlock (maintaining the latch in the first latch position).

Figure 13B:
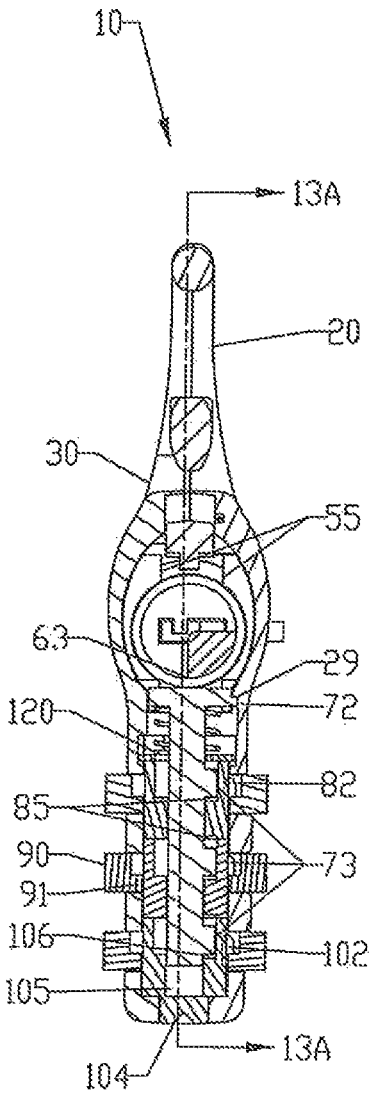
FIG. 13B is a cross-sectional view of the first body half taken along line 13B-13B of FIG. 13A.

Unlock by Key Mode (FIGS. 13A-13B)

If a correct key cut key 140 is inserted in the cylinder 60, then the wafer will move away from the wafer slot 55 of the button and the cylinder can rotate. As the cylinder rotates, the extended-edge 63 of the cylinder 60 will rotate and contact the surface 153 of the latch 150. As the extended-edge 63 rotates further, then the surface 153 will travel further downward such that the tip 151 of the latch 150 will disengage away from cut-out 45 of the locking-finger 40. Then the torque spring 110 will rotate the locking-finger 40 to the open position automatically.

The key user can withdraw the key as the locking-finger 40 does not require the key for further usage on relocking since the tip 151 of the latch 150 has still not engaged back to the cut-out 45 of the locking-finger 40. As the key user counter-rotates the cylinder, then he/she can withdraw the key. In the relocking process, the extended-edge 63 has already been rotated to the lock position but the latch still has not been pushed back to the first latch (lock) position. When the key user pushes the locking-finger 40 back to the lock position, the cutout 45 of the locking-finger 40 will line up to the tip 151 of the latch 150. The latch spring 160 will push the tip 151 to engage back to the cutout 45 of the locking-finger to the lock position.

The advantage of this arrangement is that the key user will not require the key to be inserted in the entire unlocking and relocking process.

Figure 14A:
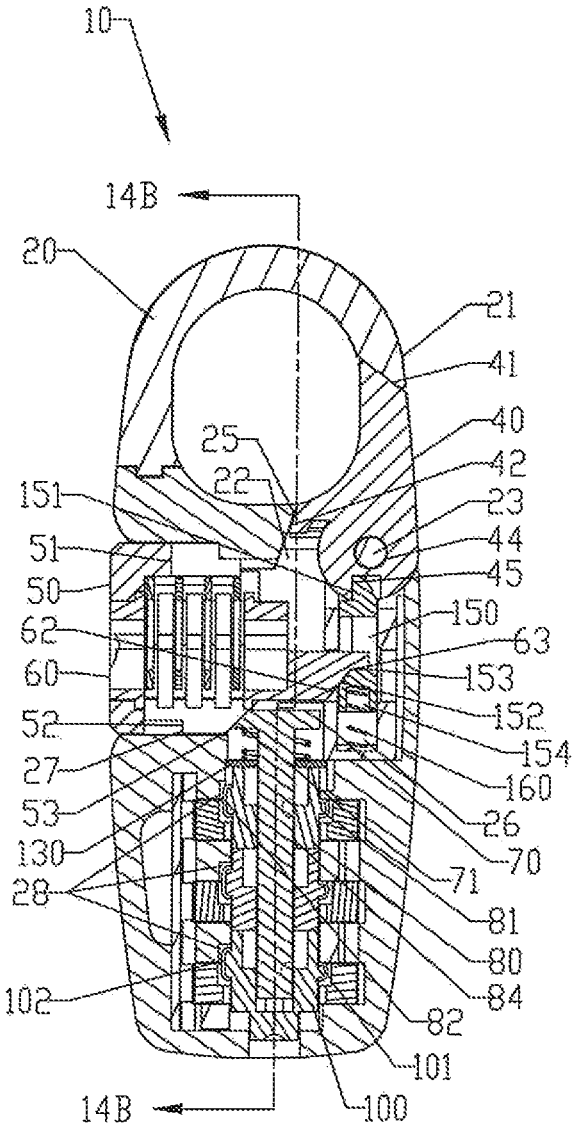
FIG. 14A is a cross-sectional view of the first body half taken along line 14A-14A of FIG. 14B.
Figure 14B:
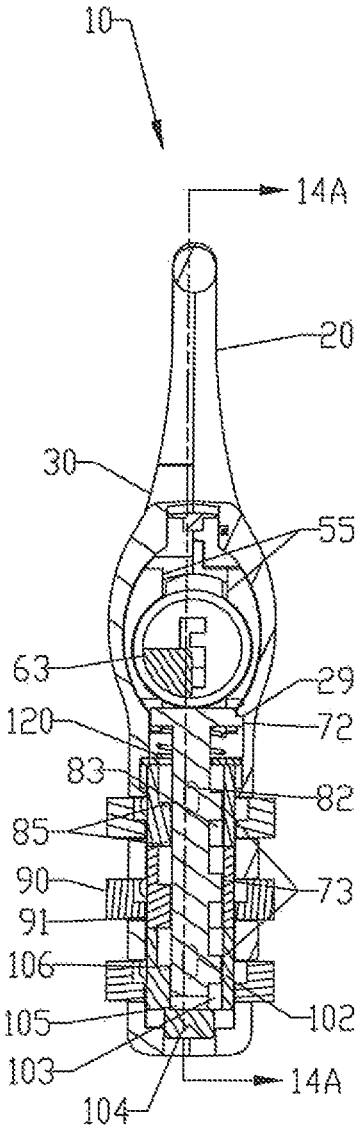
FIG. 14B is a cross-sectional view of the first body half taken along line 14B-14B of FIG. 14A.

Reset Mode (FIGS. 14A-14B)

When a lock open code has been entered into the dials, then the user can push the reset-button-with-clutch 100 inward. As the reset-button 100 is pushed inward, then the short-fin 81 and the long-fin 82 of the clutch 80 will disengage away from the teeth 91 of the dial 90. The long-fin 82 will also engage with the notch 28 of the body 20 such that the clutch will not rotate in the entire reset process. The protrusion 73 of the spindle 70 will also be engaged with the opening-gap 83/103 of the clutch 80/reset-button 100. The user can then rotate the dial to the new code. After setting, the user can release the reset-button 100 such that the spindle spring 120 will push the separation-ring 130 and the clutch 80 back to the original position such that the short-fin 81 and long-fin 82 will engage back to the teeth 91 of the dial 90.

The purpose of the separation-ring 130 is to separate the clutch 80 and the spindle spring 120 such that they will not be contacted directly.

Overview

Thus, the present invention is direct to a new hook lock. This new hook lock has a body formed by a first body portion (or the upper half) and a second body portion (or the lower half);

- a hook 21 fixedly disposed on an end of the first body portion,
- a locking finger 40 pivotally coupled to the hook 21 to prevent opening of the lock (FIG. 1A), and
- a latch 150 movable in a latch movement direction between a first latch position and a second latch position. When the latch 150 is operated in the first latch position, it prevents the locking finger 40 from decoupling from the hook 21. When the latch 150 is operated in the second latch position, it allows the locking finger 40 to pivotally decouple from the hook to open the lock (FIG. 12A). The lock 10 also has a latch-controlling mechanism which includes a button 50 and an extended-edge 63 that are operable in a control position (FIG. 1A) to prevent movement of the latch, and in a release position (FIGS. 12A, 13A) to cause the latch to move from the first latch position to the second latch position; and a spindle 70 moveable between a first spindle position (FIG. 1A) to keep the latch-controlling mechanism in the control position and a second spindle position (FIG. 12A) to allow the latch-controlling mechanism to operate in the release position;

In the lower part of the lock body, a combination mechanism having a plurality of dials 90 arranged from top to bottom relative to the body is used to control rotational movement of a plurality of clutches 80. The plurality of clutches are used to control movement of the spindle 70. In the middle part of the lock body, a key overriding-mechanism or cylinder 60 is used to cause the latch-controlling mechanism to operate in the release position, allowing the latch 150 to move from the first latch position to the second position while the spindle 70 is located in the first spindle position (FIG. 13A).

The locking finger 40 has a cut-out 45. The latch 150 has a tip 151 arranged to engage with the cut-out 45 of the locking finger 40 when the latch 150 is located in the first latch position for preventing the opening of the lock (FIG. 1A). When the latch 150 is located in the second latch position, the tip 151 moves away from the cut-out 45 of the locking finger 40 so that the locking FIG. 40 can be pushed away from the hook 21 to open the lock (FIG. 12A, 13A).

Figure 6A:
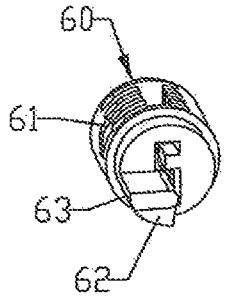
FIG. 6A is a perspective view of a cylinder forming part of the padlock.
Figure 6B:
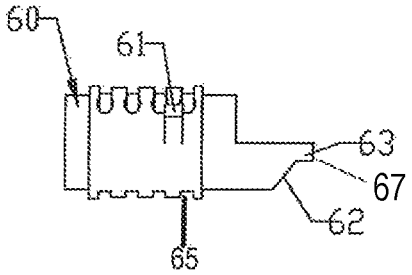
FIG. 6B is a side perspective view of the cylinder shown in FIG. 6A.
Figure 7:
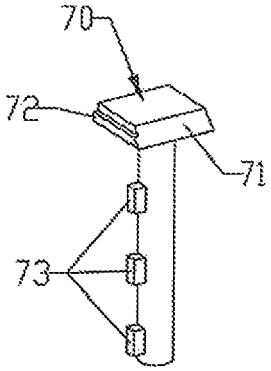
FIG. 7 is a perspective view of a spindle forming part of the padlock.
Figure 11:
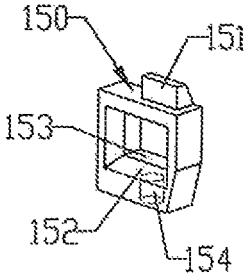
FIG. 11 is a perspective view of a slope element forming part of the padlock.
Figure 11A:
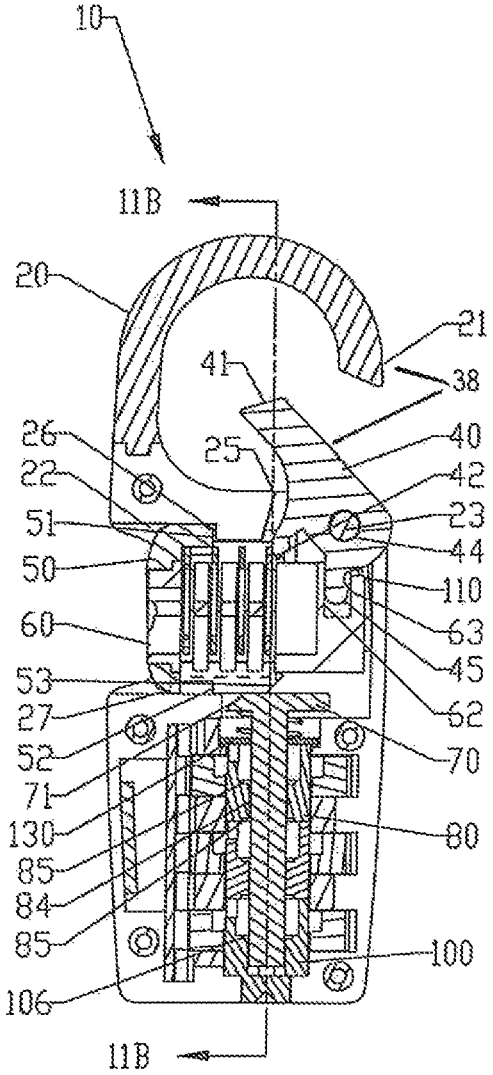
FIG. 11A is a cross-sectional view of the first body half taken along line 11A-11A of FIG. 11B.
Figure 11B:
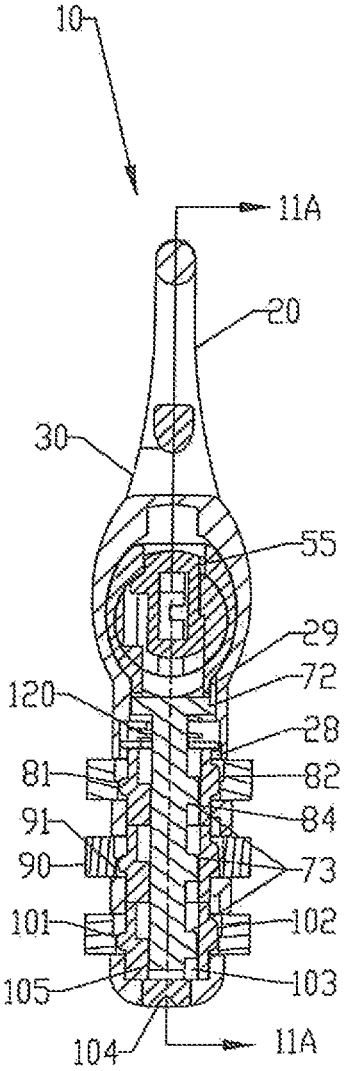
FIG. 11B is a cross-sectional view of the first body half taken along line 11B-11B of FIG. 11A.

As seen in FIG. 11, the latch 150 also has a contact member, including a surface 153 and a slope 152 positioned in relationship to the tip 151. As seen in FIGS. 6A and 6B, the key overriding-mechanism is a key-operated cylinder 60, and the extended-edge 63 of the latch-controlling mechanism is fixedly attached to the cylinder 60. The extended-edge 63 has an edge end 67 positioned in relationship to the surface 153 of the latch 150. When the cylinder 60 is turned by a key, the edge end of the extended-edge 63 is arranged to cause the surface 153 of the latch 150 to move in the latch movement direction for disengaging the tip 151 of the latch 150 from the cut-out 45 of the locking finger 40 (FIG. 13A).

The button 50 of the latch-controlling mechanism is positioned on top of the combination mechanism and coupled to the cylinder 60 for movement together. When the spindle 70 is located in the second spindle position, the button 50 can be pushed inward to move the extended-edge 63 in an edge movement direction so that the edge slope 62 at the edge end of the extended-edge 63 is arranged to engage with the slope 152 of the latch 150 and push the latch 150 downward for disengaging the tip 151 of the latch 150 from the cut-out 45 of the locking finger 40 (FIG. 12A). When the spindle 70 is located in the first spindle position, the button 50 is prevented from moving the extended-edge 63 inward to open the lock (FIG. 1A).

Figure 2:
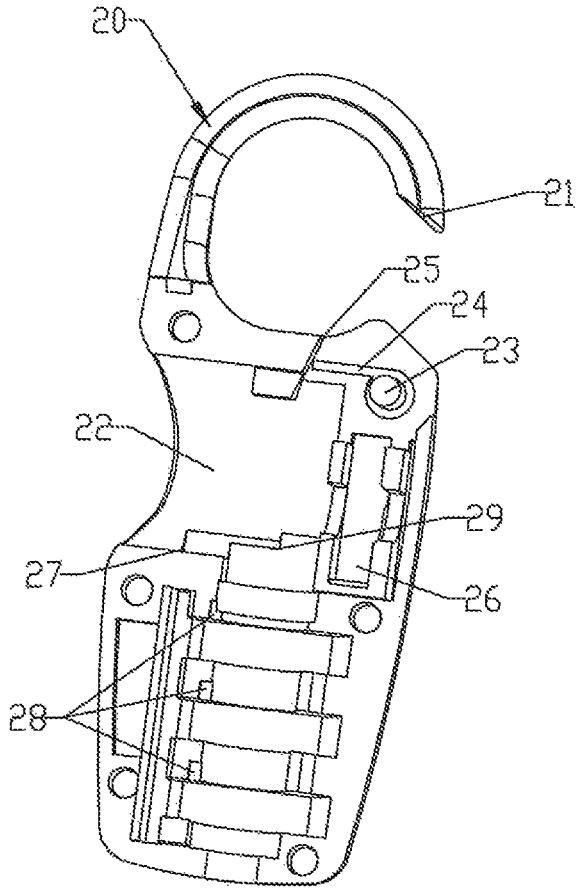
FIG. 2 is a perspective view of a first body half of the padlock.
Figure 3:
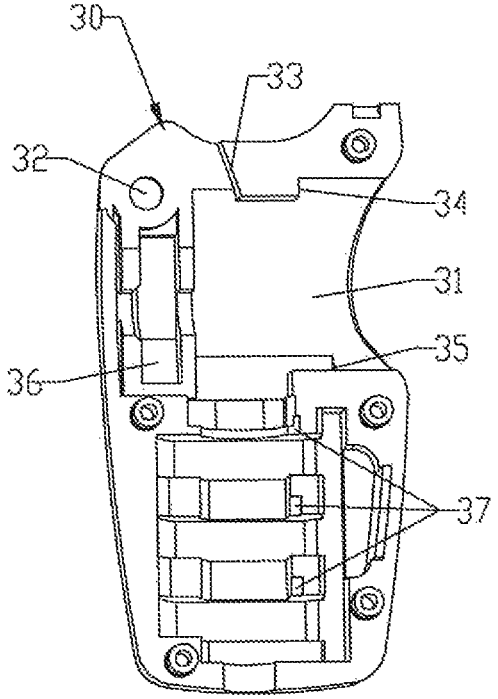
FIG. 3 is perspective view of a second body half of the padlock.
Figure 4A:
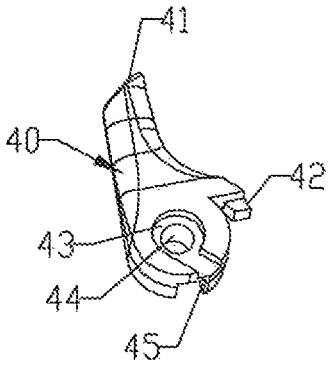
FIG. 4A is a first perspective view of a locking-finger.
Figure 4B:
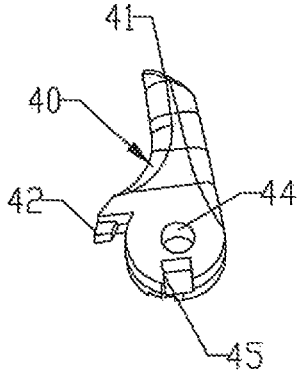
FIG. 4B is a second perspective view of the locking-finger taken from the opposite side of the locking-finger as shown in FIG. 4A.
Figure 5:
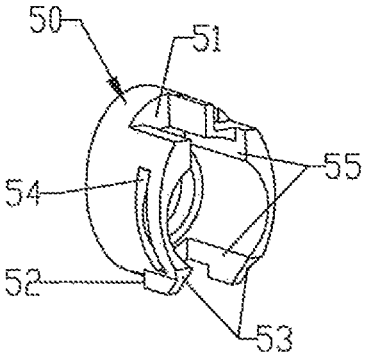
FIG. 5 is a perspective view of a button forming part of the padlock.

As seen in FIGS. 2 and 3, the upper part of the body has an opening to receive the button 50, the opening having a cut edge 27/35 arranged to prevent the button 50 from falling out of the opening. The button 50 has a wall 52 which is engaged with the cut edge 27/35 of the opening to prevent the button 50 from rotation. The cylinder 60 has a control edge 61 and the button 50 has a slot 54 dimensioned to receive the control edge 61 of the cylinder 60, allowing the cylinder 60 to turn relative to the button 50.

Figure 8A:
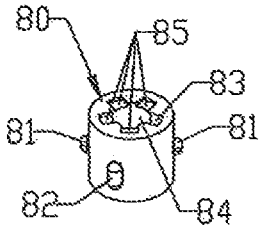
FIG. 8A is a top perspective view of a clutch forming part of the padlock.
Figure 8B:
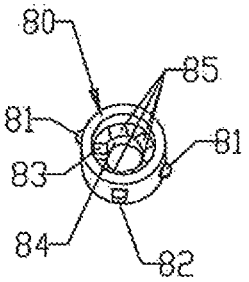
FIG. 8B is a bottom perspective view of the clutch shown in FIG. 8A.
Figure 9:
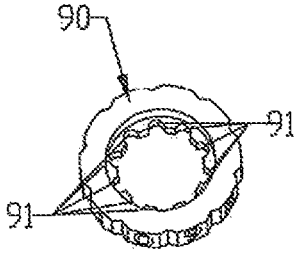
FIG. 9 is a perspective view of one of the dials forming part of the padlock.
Figure 10A:
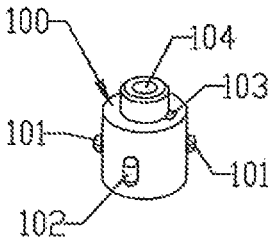
FIG. 10A is a top perspective view of a reset-button-with-clutch forming part of the padlock.
Figure 10B:
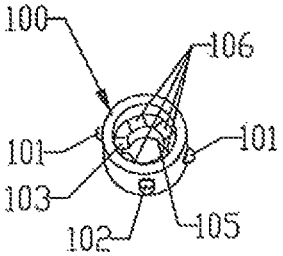
FIG. 10B is a bottom perspective view of the reset-button-with-clutch as shown in FIG. 10A.

As seen in FIGS. 8A, 8B and 9, each of the clutches 80 has an outer cylindrical surface with one or more first or shorter fins 81 and a second or longer fin 82 formed thereon. Each of the dials 90 has an inner ring with a plurality of teeth 91 formed thereon. The gap between two adjacent teeth 91 is dimensioned to receive one of the first and second fins to cause the clutches 80 to rotate together with the dials 90. Each of the clutches 80 also has an opening gap 83 formed on the inner cylindrical wall. The spindle 70 has a plurality of protrusions 73, each protrusion 73 associated with the opening gap 83 of one of the clutches 80. When the dials 90 are rotated to match a lock open code, the clutches 80 are also rotated such that the opening gap 83 of each of the clutches 80 is aligned with the associated protrusion 73, allowing the spindle 70 to move upward, from the first spindle position to the second spindle position.

As seen in FIGS. 1A, 2 and 3, the second body portion (lower half) also has a plurality of notches 28/37, each positioned in relationship to one of the clutches 80. When the spindle 70 is located in the second spindle position (lower position), the plurality of clutches 80 can be pushed away from a bottom end of the second body portion, causing the teeth 91 of the dials 90 to disengage from the first and second fins 81/82 of the clutches 80 and also causing the second or long fin 82 of each of the clutches 80 to engage with one of the notches 28/37 of the lock body for preventing the clutches 80 from rotation relative to the lock body. As such, the dials 90 can be rotated without the clutches 80 to form a different lock-open code.

REFERENCE NUMBERS

The following elements as shown in the figures are numbered as follows:

10 Padlock.

20 First body half. 21 Hook. 22 Cylinder-receiving-hole. 23 Pivot-pole.

24 Torque-spring-slot. 25 Stopping-edge. 26 Latch-path. 27 Cut-Edge.

10 28 Notch. 29 Spindle-wall. 30 Second body half. 31 Cylinder-receiving-hole.

32 Pole-receiving-hole. 33 Stopping-edge. 34 Wall. 35 Cut-Edge.

36 Latch-path. 37 Notch. 38 Loop. 40 Locking-Finger. 41 Locking-protrusion.

42 Restriction-wall. 43 Torque-spring-wall. 44 pole-receiving-hole. 45 Cut-Out.

50 Button. 51 Button-edge. 52 Wall. 53 Slope. 54 Rotational-control-slot.

55 Wafer Slot. 60 Cylinder. 61 Control-Edge. 62 Slope. 63. Extended-edge.

65. Wafer. 67. Extended-Edge End. 70 Spindle. 71 Slope. 72 Edge.

73 Protrusion. 80 Clutch. 81. Short-Fin. 82 Long-Fin. 83 Opening-Gap. 84 Hole.

85 Faulty-gates 90 Dial. 91 Teeth. 100 Reset-Button-with-Clutch. 101 Short-Fin.

102 Long-Fin. 103 Opening-Gap. 104 Button-knob 105 hole. 106 Faulty-gates.

110 Torque-Spring. 120 Spindle Spring. 130 Separation-ring. 140 Key.

150 Latch. 151 Tip. 152 Slope. 153 Surface. 154 Spring-hole. 160 Latch Spring The following elements are shown in the figures but are not numbered:

Wafer spring on the cylinder.

Ratchet spring plate using on the dials.

What is claimed is:

1. A lock comprising:

a body having a first body portion and a second body portion;

a hook fixedly disposed on an end of the first body portion, a locking finger pivotally coupled to the hook to prevent opening of the lock, a latch movable in a latch movement direction between a first latch position to prevent the locking finger from decoupling from the hook and a second latch position to allow the locking finger to pivotally decouple from the hook to open the lock;

a latch-controlling mechanism operable in a control position to prevent movement of the latch, and in a release position to cause the latch to move from the first latch position to the second latch position;

a spindle movable between a first spindle position to keep the latch-controlling mechanism in the control position and a second spindle position to allow the latch-controlling mechanism to operate in the release position, the spindle having protrusions;

a combination mechanism located in the second body portion, the combination mechanism having a plurality of dials arranged from top to bottom relative to the body, the dials configured to control rotational movement of a plurality of clutches, the plurality of clutches configured to control movement of the spindle between the first spindle position when the dials are not in a lock open code and the second spindle position when the dials are in a lock open code, and a key overriding-mechanism to allow the latch-controlling mechanism to operate in the release position for causing the latch to move from the first latch position to the second latch position while the spindle is located in the first spindle position, wherein the locking finger comprises a cut-out, and the latch comprises a tip arranged to engage with the cut-out of the locking finger when the latch is located in the first latch position for preventing the opening of the lock, and when the latch is located in the second latch position, the tip is caused to disengage from the cut-out of the locking finger, wherein the latch further comprises a contact member positioned in relationship to the tip, and the key overriding-mechanism comprises a key-operated cylinder, wherein the latch-controlling mechanism comprises an extended edge fixedly attached to the key-operated cylinder, the extended edge having an edge end positioned in relationship to the contact member of the latch, and wherein when the key-operated cylinder is turned by a key, the edge end of the extended edge is arranged to cause the contact member to move in the latch movement direction for disengaging the tip of the latch from the cut-out of the locking finger, wherein the latch further comprises a contact member positioned in relationship to the tip, and the key overriding-mechanism comprises a key-operated cylinder, wherein the latch-controlling mechanism comprises an extended edge fixedly attached to the key-operated cylinder, the extended edge having an edge end positioned in relationship to the contact member of the latch, and wherein when the key-operated cylinder is turned by a key, the edge end of the extended edge is arranged to cause the contact member to move in the latch movement direction for disengaging the tip of the latch from the cut-out of the locking finger, wherein the latch-controlling mechanism further comprises a button positioned in relationship to the combination mechanism, the button coupled to the key-operated cylinder for movement together, wherein the key-operated cylinder is placed inside a rotational-control-slot so that a wafer is inserted in the key-operated cylinder so that a spring of the wafer pushes outwards and contacts a wafer slot to prevent the key-operated cylinder from rotational movement, wherein when the spindle is located in the second spindle position, the button can be pushed to move the extended edge in an edge movement direction, wherein the edge end is arranged to engage with the contact member of the latch so as to disengage the tip of the latch from the cut-out of the locking finger, and when the spindle is located in the first spindle position, the button is prevented from moving the extended edge in the edge movement direction, wherein the lock has a reset-button-with-latch so as to prevent the spindle from moving downward if the reset-button-with-latch is not fully aligned with the protrusions of the spindle, wherein each of the plurality of clutches has a front and a back and each has faulty gates located in the front and back of said clutches, wherein the faulty gates are configured so that when the dials are not in the lock open code and the button is pushed so that it contacts the spindle, the protrusions of the spindle contact the faulty gates located in the front of the clutches to thereby make a clicking sound to increase the difficulty of discovering the first spindle position, and wherein the faulty gates located in the back of the clutches are configured so that when the reset-button-with-latch is pushed inward, then the clutches are pushed to contact the protrusions of the spindle, so that the faulty gates in the back of the clutches also make a clicking sound to increase the difficulty of discovering the first spindle position.

2. The lock according to claim 1, wherein the extended edge has an edge slope and the latch has a latch slope arranged to contact the edge slope, and wherein when the extended edge is moved in the edge movement direction, the latch is caused to move in the latch movement direction from the first latch position to the second latch position by the edge slope of the extended edge.

3. The lock according to claim 1, wherein the extended edge has an edge surface, and the contact member of the latch has a contact surface arranged to contact the edge surface, and wherein when the key-operated cylinder is turned, the edge surface of the extended edge causes the contact surface of the contact member to move in the latch movement direction so as to disengage the tip of the latch from the cut-out of the locking finger.

4. The lock according to claim 1, wherein the first body portion has an opening dimensioned to receive the button, the opening having a cut edge arranged to prevent the button from falling out of the opening, and the button has a wall engaged with the cut edge of the opening to prevent the button from rotation, and wherein the key-operated cylinder has a control edge and the button has a slot dimensioned to receive the control edge, allowing the key-operated cylinder to turn relative to the button.

5. The lock according to claim 1, wherein each of the clutches has an outer cylindrical surface to dispose thereon one or more first fins and a second fin longer than the first fins, and each of the dials has an inner ring to provide a plurality of teeth, a gap of two adjacent teeth dimensioned to receive one of the first and second fins to cause the clutches to rotate together with the dials, and wherein each of the clutches further comprises an inner cylindrical wall having thereon an opening gap, and the spindle comprises a plurality of protrusions, each protrusion associated with the opening gap of one of the clutches, wherein when the dials are rotated to match a lock open code, the clutches are also rotated such that the opening gap of each of the clutches is aligned with the associated protrusion, allowing the spindle to move from the first spindle position to the second spindle position.

6. The lock according to claim 5, wherein the second body also has a plurality of notches, each positioned in relationship to one of the clutches, wherein when the spindle is located in the second spindle position, the plurality of clutches can be pushed away from a bottom end of the second body portion, causing the teeth of the dials to disengage from the first and second fins of the clutches and also causing the second fin of each of the clutches to engage with one of the notches so as to prevent the clutches from rotation relative to the body and allowing the dials to rotate without the clutches to form a different lock open code.

7. The lock according to claim 1, wherein when the key is inserted into the key-operated cylinder, the wafers are caused to move into the key-operated cylinder and move out of the wafer slot of the button, allowing the key-operated cylinder to turn to move in the latch movement direction so as to disengage the tip of the latch from the cut-out of the locking finger.

8. A lock comprising:

a body having a first body portion and a second body portion;

a hook fixedly disposed on an end of the first body portion, a locking finger pivotally coupled to the hook to prevent opening of the lock, a latch movable in a latch movement direction between a first latch position to prevent the locking finger from decoupling from the hook and a second latch position to allow the locking finger to pivotally decouple from the hook to open the lock;

a latch-controlling mechanism operable in a control position to prevent movement of the latch, and in a release position to cause the latch to move from the first latch position to the second latch position;

a spindle movable between a first spindle position to keep the latch-controlling mechanism in the control position and a second spindle position to allow the latch-controlling mechanism to operate in the release position, the spindle having protrusions;

a combination mechanism located in the second body portion, the combination mechanism having a plurality of dials arranged from top to bottom relative to the body, the dials configured to control rotational movement of a plurality of clutches, the plurality of clutches configured to control movement of the spindle between the first spindle position when the dials are not in a lock open code and the second spindle position when the dials are in a lock open code, and a key overriding-mechanism to allow the latch-controlling mechanism to operate in the release position for causing the latch to move from the first latch position to the second latch position while the spindle is located in the first spindle position, wherein the lock has a reset-button-with-latch so as to prevent the spindle from moving downward if the reset-button-with-latch is not fully aligned with the protrusions of the spindle, wherein each of the plurality of clutches has a front and a back and each has faulty gates located in the front and back of said clutches, wherein the faulty gates are configured so that when the dials are not in the lock open code and the button is pushed so that it contacts the spindle, the protrusions of the spindle contact the faulty gates located in the front of the clutches to thereby make a clicking sound to increase the difficulty of discovering the first spindle position, and wherein the faulty gates located in the back of the clutches are configured so that when the reset-button-with-latch is pushed inward, then the clutches are pushed to contact the protrusions of the spindle, so that the faulty gates in the back of the clutches also make a clicking sound to increase the difficulty of discovering the first spindle position.

9. The lock according to claim 8, wherein the locking finger comprises a cut-out, and the latch comprises a tip arranged to engage with the cut-out of the locking finger when the latch is located in the first latch position for preventing the opening of the lock, and when the latch is located in the second latch position, the tip is caused to disengage from the cut-out of the locking finger.

10. The lock according to claim 9, wherein the latch further comprises a contact member positioned in relationship to the tip, and the key overriding-mechanism comprises a key-operated cylinder, wherein the latch-controlling mechanism comprises an extended edge fixedly attached to the cylinder, the extended edge having an edge end positioned in relationship to the contact member of the latch, and wherein when the cylinder is turned by a key, the edge end of the extended edge is arranged to cause the contact member to move in the latch movement direction for disengaging the tip of the latch from the cut-out of the locking finger.

11. The lock according to claim 10, wherein the latch-controlling mechanism further comprises a button positioned in relationship to the combination mechanism, the button coupled to the cylinder for movement together, wherein when the spindle is located in the second spindle position, the button can be pushed to move the extended edge in an edge movement direction and wherein the edge end is arranged to engage with the contact member of the latch so as to disengage the tip of the latch from the cut-out of the locking finger, and when the spindle is located in the first spindle position, the button is prevented from moving the extended edge in the edge movement direction.

12. The lock according to claim 11, wherein the extended edge has an edge slope and the latch has a latch slope arranged to contact the edge slope, and wherein when the extended edge is moved in the edge movement direction, the latch is caused to move in the latch movement direction from the first latch position to the second latch position by the edge slope of the extended edge.

13. The lock according to claim 11, wherein the first body portion has an opening dimensioned to receive the button, the opening having a cut edge arranged to prevent the button from falling out of the opening, and the button has a wall engaged with the cut edge of the opening to prevent the button from rotation, and wherein the cylinder has a control edge and the button has a slot dimensioned to receive the control edge, allowing the cylinder to turn relative to the button.

14. The lock according to claim 11, wherein the cylinder has a plurality of movable wafers and the button has a wafer slot dimensioned to receive the wafers so as to prevent the cylinder from rotation relative to the button, and wherein when the key is inserted into the cylinder, the wafers are caused to retrieve into the cylinder and move out of the wafer slot of the button, allowing the cylinder to turn to move in the latch movement direction so as to disengage the tip of the latch from the cut-out of the locking finger.

15. The lock according to claim 10, wherein the extended edge has an edge surface, and the contact member of the latch has a contact surface arranged to contact the edge surface, and wherein when the cylinder is turned, the edge surface of the extended edge causes the contact surface of the contact member to move in the latch movement direction so as to disengage the tip of the latch from the cut-out of the locking finger.

16. The lock according to claim 8, wherein each of the clutches has an outer cylindrical surface to dispose thereon one or more first fins and a second fin longer than the first fins, and each of the dials has an inner ring to provide a plurality of teeth, a gap of two adjacent teeth dimensioned to receive one of the first and second fins to cause the clutches to rotate together with the dials, and wherein each of the clutches further comprises an inner cylindrical wall having thereon an opening gap, and the spindle comprises a plurality of protrusions, each protrusion associated with the opening gap of one of the clutches, wherein when the dials are rotated to match a lock open code, the clutches are also rotated such that the opening gap of each of the clutches is aligned with the associated protrusion, allowing the spindle to move from the first spindle position to the second spindle position.

17. The lock according to claim 16, wherein the second body also has a plurality of notches, each positioned in relationship to one of the clutches, wherein when the spindle is located in the second spindle position, the plurality of clutches can be pushed away from a bottom end of the second body portion, causing the teeth of the dials to disengage from the first and second fins of the clutches and also causing the second fin of each of the clutches to engage with one of the notches so as to prevent the clutches from rotation relative to the body and allowing the dials to rotate without the clutches to form a different lock open code.

* * * * *